US008589053B2

(12) United States Patent
Keiner et al.

(10) Patent No.: US 8,589,053 B2
(45) Date of Patent: Nov. 19, 2013

(54) METHOD AND CONTROL DEVICE FOR DETECTING THE DIRECTION OF ROTATION OF A DRIVE SHAFT OF AN INTERNAL COMBUSTION ENGINE FOR A MOTOR VEHICLE

(75) Inventors: Thomas Keiner, Wetzlar (DE); Christoph Schnurrer, Oberursel (DE)

(73) Assignee: Continental Automotive GmbH, Hannover (DE)

( * ) Notice: Subject to any disclaimer, the term of this patent is extended or adjusted under 35 U.S.C. 154(b) by 482 days.

(21) Appl. No.: 13/057,800

(22) PCT Filed: Jul. 1, 2009

(86) PCT No.: PCT/EP2009/058254
§ 371 (c)(1),
(2), (4) Date: Feb. 7, 2011

(87) PCT Pub. No.: WO2010/015464
PCT Pub. Date: Feb. 11, 2010

(65) Prior Publication Data

US 2011/0144890 A1 Jun. 16, 2011

(30) Foreign Application Priority Data

Aug. 7, 2008 (DE) ..... 10 2008 036 818

(51) Int. Cl.
*F02D 41/00* (2006.01)
*F02D 41/22* (2006.01)

(52) U.S. Cl.
USPC ..... 701/103

(58) Field of Classification Search
USPC ..... 701/103–105, 101, 102, 110, 115; 123/198 DB, 198 F, 478, 480, 481, 491, 123/406.58
See application file for complete search history.

(56) References Cited

U.S. PATENT DOCUMENTS 4,939,954 A * 7/1990 Walzer et al. ..... 74/733.1
6,324,488 B1 11/2001 Siegl ..... 702/151

(Continued)

FOREIGN PATENT DOCUMENTS

DE 19735722 A1 2/1999
DE 102004045153 A1 3/2006

(Continued)

OTHER PUBLICATIONS

International PCT Search Report and Written Opinion, PCT/EP2009/058254, 11 pages, Oct. 15, 2009.
German Office Action, German Patent Application No. 10 2008 036 818.0-26, 3 pages, Apr. 29, 2009.

*Primary Examiner* — Hieu T Vo
(74) *Attorney, Agent, or Firm* — King & Spalding L.L.P.

(57) ABSTRACT

In a method for determining the direction of rotation of a drive shaft (13) of an internal combustion engine (1) without using a sensor specifically provided therefor, an operating variable of the internal combustion engine (1) is measured using a sensor in a gas line (40, 16), which connects a combustion chamber (30) of the internal combustion engine (1) to the surrounding area. The operating variable is calculated using a model. A forward direction of rotation of the drive shaft (13) is detected if the difference between the measured value of the operating variable and the model value of the operating variable lies within a specified tolerance range. Otherwise, a reverse direction of rotation of the drive shaft (13) is detected, which is opposite of the forward direction of rotation.

20 Claims, 2 Drawing Sheets

(56) References Cited

U.S. PATENT DOCUMENTS

| | | | | |
|---|---|---|---|---|
| 6,694,837 | B2 * | 2/2004 | Yeh | 74/377 |
| 6,975,935 | B2 * | 12/2005 | Kohler et al. | 701/114 |
| 7,159,571 | B2 * | 1/2007 | Kassner | 123/479 |
| 7,559,871 | B2 * | 7/2009 | Amano et al. | 477/3 |
| 2005/0240337 | A1 | 10/2005 | Kohler et al. | 701/114 |
| 2006/0162701 | A1 | 7/2006 | Kassner | 123/479 |

FOREIGN PATENT DOCUMENTS

| | | | |
|---|---|---|---|
| DE | 102004048132 | A1 | 4/2006 |
| JP | 11062687 | A | 3/1999 |
| WO | 2004/036017 | A | 4/2004 |

* cited by examiner

METHOD AND CONTROL DEVICE FOR DETECTING THE DIRECTION OF ROTATION OF A DRIVE SHAFT OF AN INTERNAL COMBUSTION ENGINE FOR A MOTOR VEHICLE

CROSS-REFERENCE TO RELATED APPLICATIONS

This application is a U.S. National Stage Application of International Application No. PCT/EP2009/058254 filed Jul. 1, 2009, which designates the United States of America, and claims priority to German Application No. 10 2008 036 818.0 filed Aug. 7, 2008, the contents of which are hereby incorporated by reference in their entirety.

TECHNICAL FIELD

The invention relates to a method for detecting the direction of rotation of a drive shaft of an internal combustion engine for a motor vehicle and a corresponding control device.

BACKGROUND

The internal combustion engines used in automotive engineering have a drive shaft by way of which the energy produced during the combustion is transferred in the form of a torque to the drive train of the motor vehicle to be driven. In the case of reciprocating piston engines this drive shaft is referred to as the crankshaft. As a basic principle the drive shaft is mounted in such a manner that it is capable of rotating in two opposite directions of rotation. However, many important components of the internal combustion engine are calibrated only for one direction of rotation of the drive shaft, referred to in the following as forward direction of rotation. Thus for example the entire intake tract, the components and sensors contained therein, are designed only to guarantee the fresh air supply of the internal combustion engine. Similarly, for example, the exhaust tract of the internal combustion engine is designed only for discharging the hot combustion exhaust gases from the combustion chambers into the surrounding area. The same also applies for example to the control of the inlet and outlet valves, the opening times of which are designed only for operation in the forward direction of rotation. Furthermore, most modern internal combustion engines have an electronic control device which controls the fresh-air mass flow, the ignition and the fuel injection on the basis of the output signals from the sensors. The control functions implemented in the control device guarantee the correct interaction of all actuators, but only for the case where the drive shaft rotates in the forward direction of rotation. There are however driving situations in which a reverse rotation of the drive shaft is possible, for example if the motor vehicle is rolling backwards with the drive train closed (gear selected) on a steep slope. If the reverse rotation of the drive shaft is not detected, considerable damage to the internal combustion engine can occur as a result of the fuel injection and the ignition being started.

Hitherto, detection of the reverse rotation of the drive shaft has only been possible by means of a specially designed and costly sensor. With the aim of reducing the production costs of motor vehicles, the motor vehicle manufacturers endeavor to further reduce the number of sensors.

SUMMARY

According to various embodiments, a method and a device can be provided, by means of which the direction of rotation of the drive shaft of the internal combustion engine can also be detected without a special sensor detecting the direction of rotation and thus enabling a reduction in the production costs of the internal combustion engine.

According to an embodiment, in a method for detecting the direction of rotation of a drive shaft of an internal combustion engine for a motor vehicle,—an operating variable of the internal combustion engine is measured using a sensor in a gas line which connects a combustion chamber of the internal combustion engine to the surrounding area,—the operating variable is calculated using a model, and—a forward direction of rotation of the drive shaft is detected if the difference between the measured value of the operating variable and the model value of the operating variable lies within a specified tolerance range, and otherwise a reverse direction of rotation of the drive shaft is detected which is opposite to the forward direction of rotation.

According to a further embodiment, the operating variable can be one of the following variables:—the pressure at a position inside an intake tract or an exhaust tract of the internal combustion engine,—the temperature at a position inside the intake tract or an exhaust tract of the internal combustion engine, and—the gas flow rate in the intake tract of the internal combustion engine. According to a further embodiment, the fuel supply can be suppressed if it is detected that the drive shaft is rotating in the reverse direction of rotation. According to a further embodiment, with fuel supply disabled firstly the direction of rotation of the drive shaft can be determined and fuel supply may only be enabled in the situation when it is detected that the drive shaft is rotating in the forward direction of rotation. According to a further embodiment, the fuel supply can be released or remains released if the speed of the motor vehicle is greater than a specified speed threshold value. According to a further embodiment, the fuel supply can be released or remains released if the rotational speed of the drive shaft is greater than a specified rotational speed threshold value. According to a further embodiment, the fuel supply can be released or remains released if the drive shaft is rotated by a starter motor associated with the internal combustion engine or if a request to start the internal combustion engine is detected.

According to another embodiment, a control device for an internal combustion engine may be equipped with means in such a manner that in order to detect the direction of rotation of a drive shaft of the internal combustion engine—an operating variable of the internal combustion engine is measured using a sensor in a gas line which connects a combustion chamber of the internal combustion engine to the surrounding area,—the operating variable is calculated using a model, and—a forward direction of rotation of the drive shaft is detected if the difference between the measured value of the operating variable and the model value of the operating variable lies within a specified tolerance range, and otherwise a reverse direction of rotation of the drive shaft is detected which is opposite to the forward direction of rotation.

BRIEF DESCRIPTION OF THE DRAWINGS

The invention will be described in detail in the following on the basis of an exemplary embodiment with reference to the attached figures. In the figures.

DETAILED DESCRIPTION

Figure 1:
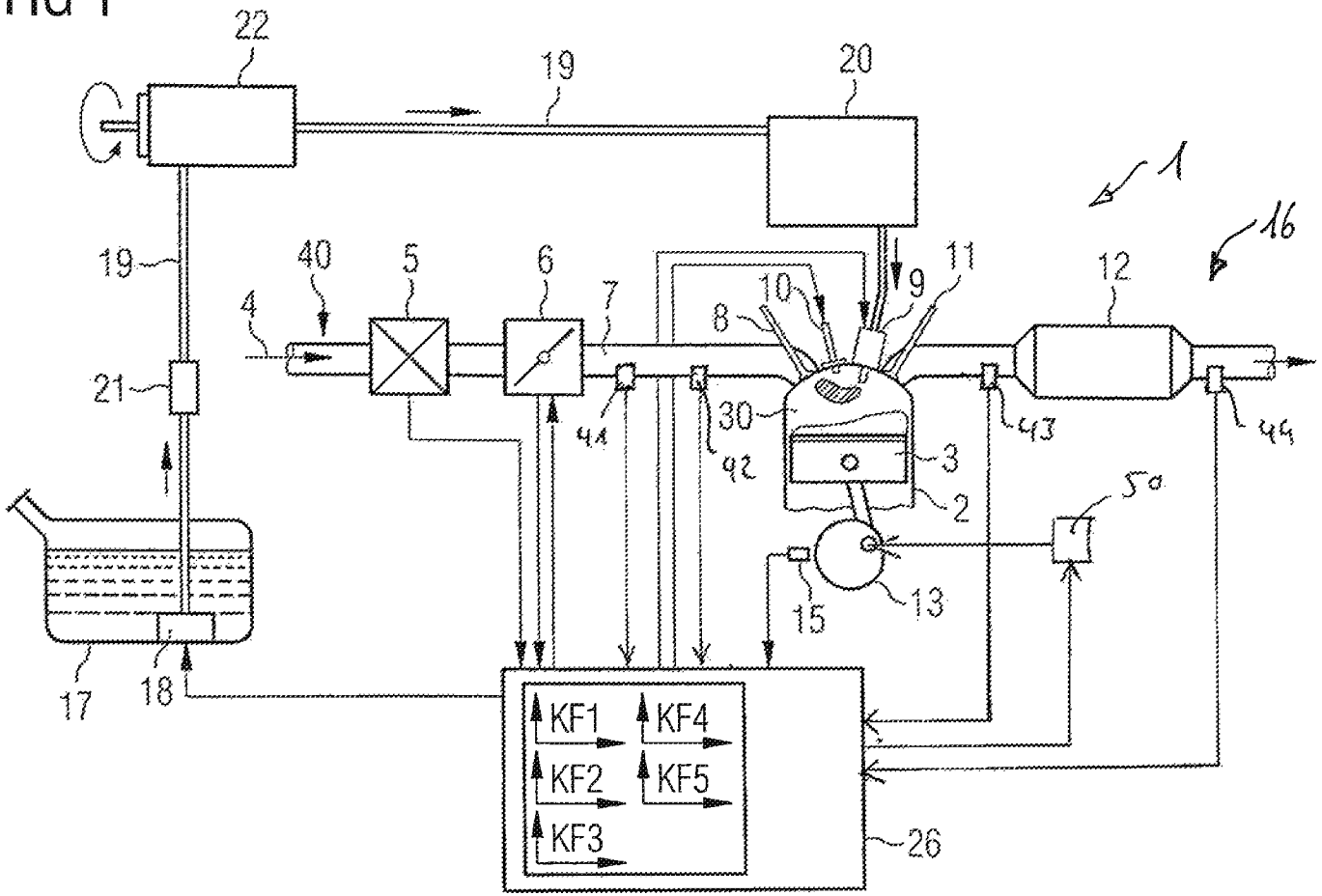
FIG. 1 shows a schematic illustration of an internal combustion engine.

A method in accordance with an embodiment is suitable for determining the direction of rotation of a drive shaft of an internal combustion engine for a motor vehicle. To this end, an operating variable of the internal combustion engine is measured using a sensor in a gas line which connects a combustion chamber of the internal combustion engine to the surrounding area. Said operating variable is calculated using a correspondingly designed model. A forward direction of rotation of the drive shaft is detected if the difference between the measured value of the operating variable and the model value of the operating variable lies within a specified tolerance range. Otherwise, a reverse direction of rotation of the drive shaft is detected, which is opposite to the forward direction of rotation.

The forward direction of rotation of the drive shaft is understood to be the normal direction of rotation of the drive shaft, in which the drive shaft of the internal combustion engine rotates under normal conditions when combustion is taking place in the combustion chambers. To start the internal combustion engine the drive shaft is therefore rotated in the forward direction of rotation by means of a starter motor. The components of the internal combustion engine and their interaction are designed and calibrated in such a manner that the internal combustion engine functions correctly without damaging the components. In order to control the internal combustion engine, in other words the torque produced by the internal combustion engine, different sensors which measure different operating variables are arranged in the gas lines by way of which the combustion chambers of the internal combustion engine communicate with the surrounding area. Said sensors include in particular sensors for measuring the pressure, the temperature and the gas flow rate inside the gas lines. Here, gas flow rate is understood as the gas mass flow or alternatively the gas volume flow. The term gas lines refers in particular to the intake tract and the exhaust tract. In order to control the actuators of the internal combustion engine, one or more models in the form of software are stored in a control device, which models calculate the same operating variables inside the gas lines on the basis of the different sensor output variables, engine characteristics and/or physical laws. These models are however designed in such a manner that a correct calculation of these operating variables is guaranteed only when the drive shaft is rotating in the forward direction of rotation. On the assumption that the sensors are functioning correctly and the model is calibrated to the configuration of the internal combustion engine, the measured value of the operating variable and the associated model value of the operating variable differ only slightly—but only if the drive shaft is rotating in the forward direction of rotation. If however the drive shaft is rotating in the reverse direction of rotation, then a reversal of direction occurs of the gas stream flowing through the gas line of the internal combustion engine, as a result of which the actual values of the operating variables change significantly. These significant changes are however only sensed by the corresponding sensors. The model on the other hand continues to be based on a rotation of the drive shaft in the forward direction of rotation, which means that a considerable deviation of the measured values of the operating variables from the associated model values occurs. According to various embodiments, the direction of rotation of the drive shaft is detected based on the difference between the measured value and the corresponding model value of the operating variable. The method offers the advantage that in order to detect the direction of rotation of the drive shaft a sensor which is as a rule present as standard for sensing an operating variable in the gas line of the internal combustion engine and a model which is as a rule implemented as standard for calculating said operating variable are sufficient. A costly sensor which is capable of directly sensing the direction of rotation of the drive shaft can be saved. This means that the production costs of the internal combustion engine can be further reduced.

In an embodiment of the method, the operating variable in question is one of the following variables:

- the pressure at a position inside an intake tract or an exhaust tract of the internal combustion engine;
- the temperature at a position inside the intake tract or an exhaust tract of the internal combustion engine;
- the gas flow rate in the intake tract of the internal combustion engine.

For at least one of the aforementioned operating variables, one measured value and one associated model value are as a rule available. Pressure, temperature and the gas flow rate inside the intake tract or the exhaust tract of the internal combustion engine change in the event of a reversal in the direction of rotation of the drive shaft. Here, gas flow rate is understood as the gas mass flow or alternatively the gas volume flow. These variables are therefore particularly well suited for executing the method according to an embodiment.

With regard to a further embodiment of the method, the fuel injection is suppressed if it is detected that the drive shaft is rotating in the reverse direction of rotation.

With regard to a further embodiment of the method, with fuel injection disabled firstly the direction of rotation of the drive shaft is determined and fuel injection is only enabled in the situation when it is detected that the drive shaft is rotating in the forward direction of rotation.

The above embodiments of the method serve to reliably prevent a fuel supply taking place and a combustion occurring in the event of rotation of the drive shaft in the reverse direction of rotation. This means that it is possible to reliably avoid considerable damage to the internal combustion engine.

In accordance with further embodiments of the method, the fuel injection is released or remains released if the speed of the motor vehicle is greater than a specified speed threshold value, and/or if the rotational speed of the drive shaft is greater than a specified rotational speed threshold value, and/or if the drive shaft is rotated by a starter motor associated with the internal combustion engine or if a request to start the internal combustion engine is detected by means of the drive motor.

The scenarios represented are used for plausibility checking of the result with regard to the detection of the direction of rotation of the drive shaft. With regard to the scenarios represented above, the reverse rotation of the drive shaft is very improbable or can be completely excluded. The fuel supply, or fuel injection, can be released or remains released. A fuel injection and a combustion are therefore possible without restrictions.

A control device for an internal combustion engine in accordance with yet another embodiment is equipped with means in such a manner that the above described method can be executed in order to detect the direction of rotation of a drive shaft of the internal combustion engine. With respect to the advantages resulting therefrom, reference is made to the descriptions for the respective methods. These apply here in an analogous manner.

An internal combustion engine 1 is illustrated schematically in FIG. 1. In the interests of improved clarity, the illustration has been greatly simplified.

The internal combustion engine 1 comprises at least one cylinder 2 and a piston 3 capable of moving up and down in the cylinder 2. The internal combustion engine 1 furthermore comprises an intake tract 40, in which an air flow sensor 5, a throttle valve 6, and an induction manifold 7 are arranged downstream of an intake port 4 for the intake of fresh air. Also arranged in the intake tract are a first pressure sensor 41 and a first temperature sensor 42. In the exemplary embodiment the pressure sensor 41 senses the pressure in the induction manifold 7. However, the first pressure sensor 41 and the first temperature sensor 42 may also be placed at other positions in the intake tract 40. Both the pressure in the induction manifold 7 and also the air-mass flow in the intake tract 40 represent a measure of the load of the internal combustion engine 1.

The intake tract 40 leads to a combustion chamber 30 delimited by the cylinder 2 and the piston 3. The fresh air required for the combustion is introduced by way of the intake tract 40 into the combustion chamber 30, whereby the fresh air supply is controlled by opening and closing an inlet valve 8. With regard to the internal combustion engine 1 illustrated here, this is an internal combustion engine 1 having direct fuel injection wherein the fuel is injected by way of an injection valve 9 directly into the combustion chamber 30 and wherein optionally a stratified (stratified injection operation) or a homogeneous (homogenous operation) preparation of combustible mixture is possible in the combustion chamber 30. The invention is however also applicable to internal combustion engines having intake manifold fuel injection. A spark plug 10 is used to trigger the combustion.

The combustion exhaust gases are discharged by way of an outlet valve 11 into an exhaust tract 16 of the internal combustion engine 1 and cleaned by means of an exhaust gas catalytic converter 12 arranged in the exhaust tract 16. A second pressure sensor 43 and a second temperature sensor 44 are arranged in the exhaust tract. Advantageously, the second pressure sensor is arranged downstream of the catalytic converter 12. Both the second pressure sensor 43 and also the second temperature sensor 44 may also be arranged at other positions in the exhaust tract 16.

Both the intake tract 40 and also the exhaust tract constitute gas lines which connect the combustion chambers 30 of the internal combustion engine 1 with the surrounding area, in other words the combustion chambers communicate with the surrounding area by way of the gas lines. The air flow sensor 5, the first temperature sensor 42, the second temperature sensor 44, the first pressure sensor 41 and the second pressure sensor 42 constitute sensing means for sensing the air mass flow, pressure or temperature operating variables in these gas lines.

The internal combustion engine 1 has a fuel supply system which has a fuel tank 17 and a fuel pump 18 arranged therein. The fuel is delivered to a pressure reservoir 20 by means of the fuel pump 18 by way of a supply line 19. The pressure reservoir 20 in question is a common facility from which the injection valves 9 for a plurality of cylinders 2 are supplied with pressurized fuel. In addition, a fuel filter 21 and a high-pressure pump 22 are arranged in the supply line 19. The high-pressure pump 22 serves to deliver the fuel fed by the fuel pump 18 at relatively low pressure (approx. 3 bar) to the pressure reservoir 20 at high pressure (typically up to 150 bar).

The transmission of power to a drive train of the motor vehicle (not shown) is effected by way of a drive shaft 13 coupled to the pistons 3, which is implemented as a crankshaft in the exemplary embodiment. The drive shaft 13 is mounted in such a manner that it is able to rotate in a forward direction of rotation and in a reverse direction of rotation which is opposite to the forward direction of rotation. During normal operation of the internal combustion engine 1, however, the drive shaft 13 rotates exclusively in the forward direction of rotation. For starting the internal combustion engine 1, a starter motor 50 is provided which basically drives the drive shaft 13 in the forward direction of rotation. A rotational speed sensor 15 senses the rotational speed but not the direction of rotation of the drive shaft 13.

Associated with the internal combustion engine 1 is a control device 26 which is connected by way of signal and data lines with all the actuators and sensors of the internal combustion engine 1. In particular, the control device 26 is coupled by way of data and signal lines with the fuel pump 18, the air flow sensor 5, the throttle valve 6, the first pressure sensor 41, the first temperature sensor 42, the spark plug 10, the injection valve 9, the rotational speed sensor 15, the second pressure sensor 43, the second temperature sensor 44 and the starter motor 50. Engine control functions and models (KF1 to KF5) are implemented in the form of software in the control device 26. The models are based on coded engine characteristics and/or physical laws and enable the calculation of the operating variables for air flow, pressure and temperature in the intake tract 40 and in the exhaust tract 16, in other words the gas lines of the internal combustion engine 1. Such a model is known for example from EP 0 886 725 B1. In this situation, the models are configured in such a manner that they calculate the air flow, the pressure and the temperature at those positions in the intake tract 40 and in the exhaust tract 16 at which the respective sensors 5, 41, 42, 43, 44 also take measurements. In other words, each of the measured values determined by the sensors 5, 41, 42, 43, 44 has associated with it a corresponding model value calculated by the model.

The components of the internal combustion engine 1 are engineered in respect of their mode of operation, mutual interaction, dimensioning and choice of materials in such a manner that the internal combustion engine 1 functions correctly when the drive shaft 13 is rotating in the forward direction of rotation. The same holds true for the coordination, embodiment, coding and linkage of the control functions and models implemented in the control device 26. The coding for the control functions and models is calibrated to the configuration of the internal combustion engine. The calculation and determining of operating variables and control signals does however always assume rotation of the drive shaft 13 in the forward direction of rotation. In this case, the measured value of the operating variable and the associated model value of the operating variable differ only slightly from one another. Since it is possible with the rotational speed sensor 15 to detect only the rotation of the drive shaft 13 but not the direction of rotation, the control functions and models always assume a rotation of the drive shaft 13 in the forward direction of rotation—even if the drive shaft 13 is actually rotating in the reverse direction of rotation. It is therefore evident that in the event of rotation of the drive shaft 13 in the reverse direction of rotation the start of fuel injection or combustion can result in control errors and considerable damage. Such a situation is therefore to be avoided.

Figure 2:
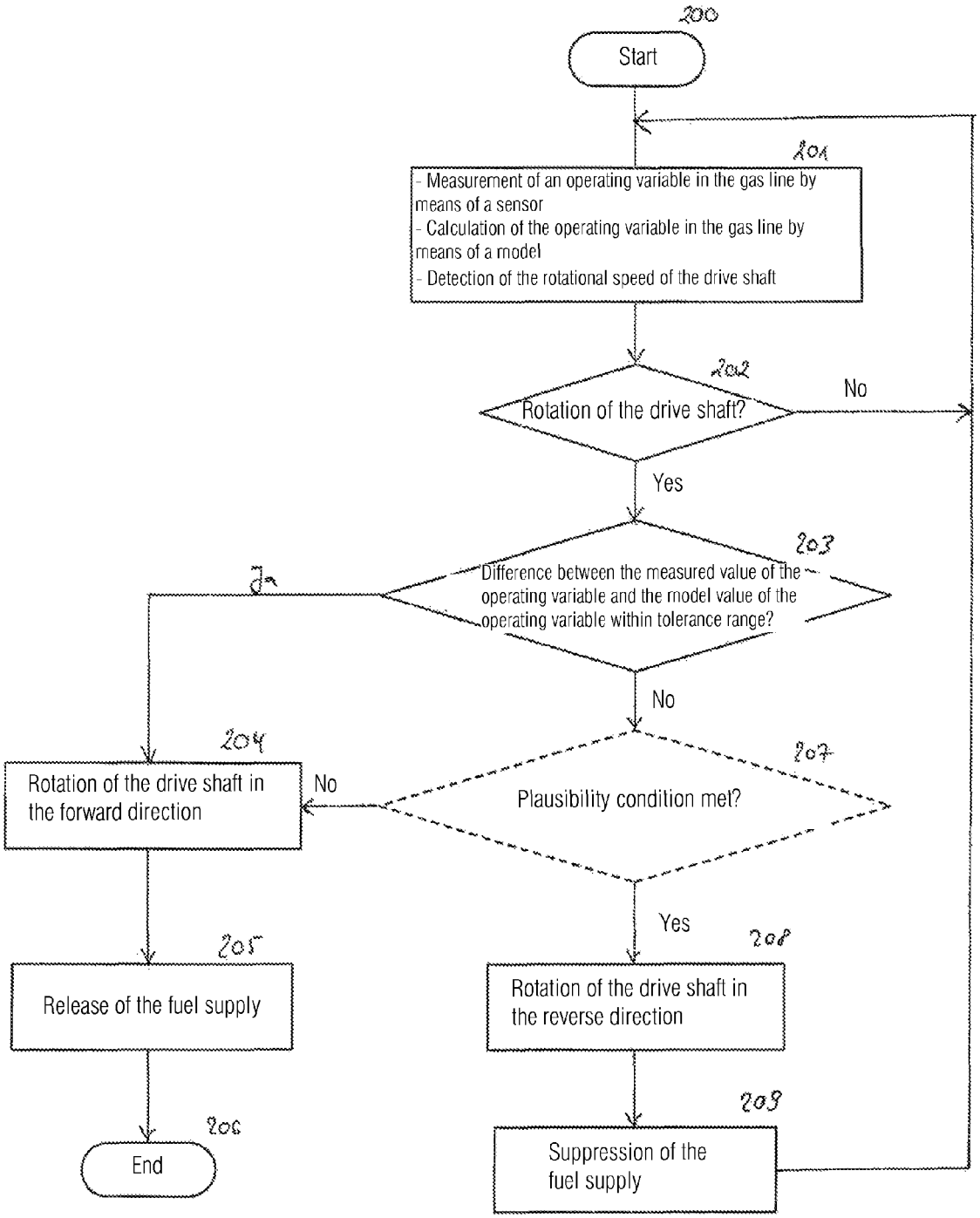
FIG. 2 shows an exemplary embodiment of a method for detecting the direction of rotation of a drive shaft of an internal combustion engine in the form a flowchart.

FIG. 2 illustrates an exemplary embodiment of a method for determining the direction of rotation of the drive shaft 13 of the internal combustion engine 1 in the form of a flowchart.

The method is started with step 200, preferably always at the point when the fuel supply, i.e. the fuel injection, is switched off. This can be both immediately prior to a start of the internal combustion engine 1, i.e. when the drive shaft 13 is stationary, or also when the drive shaft is rotating in the overrun fuel cutoff operating state.

After the method has started, at least one operating variable is measured in one of the gas lines of the internal combustion engine, in other words in the intake tract 40 and/or in the exhaust tract 16, by means of the corresponding sensor. With regard to the operating variables, these can be the temperature, the pressure at a position in the gas line or the gas flow rate through the gas line. Furthermore, at least one of the measured operating variables is calculated by means of the corresponding model implemented in the control device 26. In addition, the rotational speed of the drive shaft 13 is determined by means of the rotational speed sensor 15. These operations, stated in step 201, are repeated from the start of the method at short time intervals, which means that constantly updated values are available.

In step 202 a check is made as to whether the drive shaft 13 is rotating. This can be done for example by evaluating the output signal from the rotational speed sensor 15. If the query in step 202 yields a negative result, the method returns to step 201. If the query in step 202 yields a positive result, in other words the drive shaft 13 is rotating, the method continues with step 203.

In step 203, the difference between the measured value and the associated model value of the at least one operating variable is formed in the gas line 40, 16 and a check is made as to whether this difference lies within a specified tolerance range.

If the query in step 203 yields a positive result, the method continues with step 204 which detects that the drive shaft 13 is rotating in the forward direction of rotation. This conclusion can be reached because the model value in the case of rotation of the drive shaft 13 in the forward direction of rotation differs slightly from the corresponding measured value.

After step 204, the method continues with step 205 in which the fuel injection is released. By this means, a combustion operation of the internal combustion engine 1 is guaranteed. The method ends with step 206.

If the query in step 203 yields a negative result, the method continues with step 207 by performing a plausibility check as to whether the drive shaft 13 is rotating in the reverse direction of rotation. To this end, a check is made as to whether a specified plausibility condition is met. A plausibility condition can for example consist in the fact that the speed of the motor vehicle is less than a specified speed threshold value. The fact that the rotational speed of the drive shaft 13 is less than or equal to a specified rotational speed threshold value can be regarded as a further plausibility condition. What can further be regarded as a further plausibility condition is the fact that the drive shaft 13 is not currently being rotated by the starter motor 50 or if no request is detected for the internal combustion engine 1 to be started by means of the starter motor 50.

If the at least one plausibility condition is not met, the likelihood is very low that the drive shaft is rotating in the reverse direction of rotation although the difference between the measured value and the model value of the operating variable lies outside the tolerance range. Rather in this case, either an errored output value from the corresponding sensor or a calculation error by the model is to be assumed. For example, it is very unlikely that the drive shaft 13 is rotating in the reverse direction of rotation if the speed of the vehicle is greater than the speed threshold value. The same holds true if the speed of rotation of the drive shaft 13 is greater than the specified rotational speed threshold value. The same holds true if the rotation of the drive shaft 13 is caused by the starter motor 50 because the latter basically drives the drive shaft 13 in the forward direction of rotation.

If the query in step 207 yields a negative result, the method therefore continues with steps 204, 205 and 206 in which the forward direction of rotation of the drive shaft 13 is detected, the fuel supply is released and the method is ended.

If the query in step 207 yields a positive result, the method continues with step 208 in which it is detected that the drive shaft 13 is rotating in the reverse direction of rotation. This is expedient because a flow reversal of the air takes place in the gas lines 40, 16 when the drive shaft 13 is rotating in the reverse direction of rotation. Air is sucked from the exhaust tract 16 by way of the outlet valves 11 into the combustion chambers 3 and subsequently expelled by way of the inlet valves 8 into the intake tract 40. This means that the pressure and temperature conditions in the exhaust tract 16 and intake tract 40 change considerably. For example, pressure and temperature in the exhaust tract 16 when the drive shaft 13 is rotating in the reverse direction of rotation are considerably less than when the drive shaft 13 is rotating in a forward direction of rotation. This is due to the fact that "cool" air is sucked into the combustion chambers 3 by way of the exhaust tract 16, while in the case of a forward direction of rotation of the drive shaft 13 the "hot" gases present in the combustion chambers 3 are expelled into the exhaust tract 16 by way of the outlet valves 11.

On the other hand, the pressure and the temperature in the intake tract 40 are significantly higher when the drive shaft 13 is rotating in the reverse direction of rotation than when the drive shaft 13 is rotating in a forward direction of rotation. This can be explained by the fact that when the drive shaft 13 is rotating in the reverse direction of rotation "hot" air is expelled from the combustion chambers by way of the inlet valves 8 into the intake tract 40, whereas when the drive shaft 13 is rotating in a forward direction of rotation "cool" air is sucked into the combustion chambers 3 from the intake tract 40.

A detectable difference also results in the case of the air mass flow measured by the air flow sensor 5 in the intake tract 40 because the oncoming flow to this sensor in the case of a reverse direction of rotation of the drive shaft 13 differs considerably from the oncoming flow in the case of a forward rotation of the drive shaft 13. Since the model for calculating the air mass in the intake tract does not however take into consideration the direction of rotation of the drive shaft the model value differs significantly from the corresponding measured value.

After step 208 the method continues with step 209 in which the fuel supply to the internal combustion engine 1 is suppressed. This serves to ensure that no backflow of fuel into the intake tract 40 or even combustion of the fuel in the intake tract 40 takes place. The method is subsequently repeated from step 201.

The method presented here offers the advantage that it is possible to dispense with a costly and complex sensor for the direct detection of the direction of rotation of the drive shaft 13. The direction of rotation of the drive shaft 13 can be determined on the basis of measured values from sensors frequently present as standard in the intake tract 40 and/or in the exhaust tract and model values.

It should be noted that the plausibility check in step 207 can be performed purely optionally. It is equally possible to continue directly with step 208 after step 203. Furthermore, the plausibility conditions stated with regard to step 207 are only of an exemplary nature. It is also possible to query other conditions which allow a conclusion to be drawn concerning the likelihood of rotation of the drive shaft 13 in the reverse direction. Instead of shutting off the fuel supply in step 209, it is also possible to disable the ignition. The ignition can also be disabled in addition to the fuel supply. Generally speaking, any measure which suppresses a combustion can be taken in step 209.

It should furthermore be noted that the method functions with respect to the position of the sensors inside the intake tract or the exhaust tract. The method is applicable both to internal combustion engines having direct fuel injection and also to those having intake manifold fuel injection, to supercharged internal combustion engines or naturally aspirated engines.

What is claimed is:

1. A control device for an internal combustion engine, which is operable to detect the direction of rotation of a drive shaft of the internal combustion engine by measuring a value of an operating variable of the internal combustion engine using a sensor in a gas line which connects a combustion chamber of the internal combustion engine to the surrounding area, calculating a model value of the operating variable using a model, and determining a forward direction of rotation of the drive shaft if the difference between the measured value of the operating variable and the model value of the operating variable lies within a specified tolerance range, and otherwise determining a reverse direction of rotation of the drive shaft which is opposite to the forward direction of rotation.

2. The control device according to claim 1, wherein the operating variable is one of the following variables:

the pressure at a position inside an intake tract or an exhaust tract of the internal combustion engine, the temperature at a position inside the intake tract or an exhaust tract of the internal combustion engine, the gas flow rate in the intake tract of the internal combustion engine.

3. The control device according to claim 1, wherein the control device is further operable to suppress the fuel supply if it is detected that the drive shaft is rotating in the reverse direction of rotation.

4. The control device according to claim 3, wherein the fuel supply is released or remains released if the speed of the motor vehicle is greater than a specified speed threshold value.

5. The control device according to claim 3, wherein the fuel supply is released or remains released if the rotational speed of the drive shaft is greater than a specified rotational speed threshold value.

6. The control device according to claim 3, wherein the fuel supply is released or remains released if the drive shaft is rotated by a starter motor associated with the internal combustion engine or if a request to start the internal combustion engine is detected.

7. The control device according to claim 1, wherein with fuel supply disabled, the control device is further operable to determine firstly the direction of rotation of the drive shaft and fuel supply is only enabled in the situation when it is detected that the drive shaft is rotating in the forward direction of rotation.

8. A control device for an internal combustion engine, comprising a sensor in a gas line which connects a combustion chamber of the internal combustion engine to a surrounding area, the sensor being operable to measure a value of an operating variable of the internal combustion engine, wherein the control device is software controlled to:

calculate a model value of the operating variable using a model, and to determine a forward direction of rotation of the drive shaft if the difference between the measured value of the operating variable and the model value of the operating variable lies within a specified tolerance range, and otherwise to determine a reverse direction of rotation of the drive shaft which is opposite to the forward direction of rotation.

9. The control device according to claim 8, wherein the operating variable is one of the following variables:

the pressure at a position inside an intake tract or an exhaust tract of the internal combustion engine, the temperature at a position inside the intake tract or an exhaust tract of the internal combustion engine, the gas flow rate in the intake tract of the internal combustion engine.

10. The control device according to claim 8, wherein the control device is further software controlled to suppress the fuel supply if it is detected that the drive shaft is rotating in the reverse direction of rotation.

11. The control device according to claim 10, wherein the fuel supply is released or remains released if the speed of the motor vehicle is greater than a specified speed threshold value or if the rotational speed of the drive shaft is greater than a specified rotational speed threshold value.

12. The control device according to claim 10, wherein the fuel supply is released or remains released if the drive shaft is rotated by a starter motor associated with the internal combustion engine or if a request to start the internal combustion engine is detected.

13. The control device according to claim 8, wherein with fuel supply disabled, the control device is further software controlled to determine firstly the direction of rotation of the drive shaft and fuel supply is only enabled in the situation when it is detected that the drive shaft is rotating in the forward direction of rotation.

14. A method for detecting the direction of rotation of a drive shaft of an internal combustion engine for a motor vehicle, comprising:

measuring a value of an operating variable of the internal combustion engine using a sensor in a gas line which connects a combustion chamber of the internal combustion engine to the surrounding area, calculating a model value of the operating variable using a model, and detecting a forward direction of rotation of the drive shaft if the difference between the measured value of the operating variable and the model value of the operating variable lies within a specified tolerance range, and otherwise detecting a reverse direction of rotation of the drive shaft which is opposite to the forward direction of rotation.

15. The method according to claim 14, wherein the operating variable is one of the following variables:

the pressure at a position inside an intake tract or an exhaust tract of the internal combustion engine, the temperature at a position inside the intake tract or an exhaust tract of the internal combustion engine, the gas flow rate in the intake tract of the internal combustion engine.

16. The method according to claim 14, wherein the fuel supply is suppressed if it is detected that the drive shaft is rotating in the reverse direction of rotation.

17. The method according to claim 16, wherein the fuel supply is released or remains released if the speed of the motor vehicle is greater than a specified speed threshold value.

18. The method according to claim 16, wherein the fuel supply is released or remains released if the rotational speed of the drive shaft is greater than a specified rotational speed threshold value.

19. The method according to claim 16, wherein the fuel supply is released or remains released if the drive shaft is rotated by a starter motor associated with the internal combustion engine or if a request to start the internal combustion engine is detected.

20. The method according to claim 14, wherein with fuel supply disabled firstly the direction of rotation of the drive shaft is determined and fuel supply is only enabled in the situation when it is detected that the drive shaft is rotating in the forward direction of rotation.

* * * * *